US009222738B2

(12) United States Patent
Asher et al.

(10) Patent No.: US 9,222,738 B2
(45) Date of Patent: Dec. 29, 2015

(54) AMBIDEXTROUS CHARGING HANDLE FOR FIREARM

(71) Applicants: R. Shmuel Asher, Billings, MT (US); Van Barker, Tuttonboro, NH (US)

(72) Inventors: R. Shmuel Asher, Billings, MT (US); Van Barker, Tuttonboro, NH (US)

( * ) Notice: Subject to any disclaimer, the term of this patent is extended or adjusted under 35 U.S.C. 154(b) by 0 days.

(21) Appl. No.: 14/185,179

(22) Filed: Feb. 20, 2014

(65) Prior Publication Data

US 2015/0233657 A1 Aug. 20, 2015

(51) Int. Cl.
*F41A 3/72* (2006.01)

(52) U.S. Cl.
CPC ..... *F41A 3/72* (2013.01)

(58) Field of Classification Search
CPC ..... F41A 3/72; F41A 35/06; F41A 7/02; F41A 9/38; F41A 9/18; F41A 15/12; F41A 9/00
USPC ..... 89/1.4, 191.1, 192
See application file for complete search history.

(56) References Cited

U.S. PATENT DOCUMENTS

| | | | | |
|---|---|---|---|---|
| 3,225,653 | A | 12/1965 | Packard | |
| 7,240,600 | B1 * | 7/2007 | Bordson | 89/1.4 |
| 7,832,322 | B1 * | 11/2010 | Hoel | 89/1.4 |
| 8,104,393 | B2 * | 1/2012 | Kincel | 89/1.4 |
| 8,261,649 | B2 * | 9/2012 | Fitzpatrick et al. | 89/1.4 |
| 8,356,537 | B2 | 1/2013 | Kincel | |
| D705,383 | S * | 5/2014 | Montes | D22/108 |
| 2013/0192113 | A1 * | 8/2013 | Melville | 42/2 |
| 2014/0060293 | A1 * | 3/2014 | Gomez | 89/1.4 |

FOREIGN PATENT DOCUMENTS

WO 2007090611 A1 8/2007

* cited by examiner

*Primary Examiner* — Troy Chambers
*Assistant Examiner* — Bridget Cochran
(74) *Attorney, Agent, or Firm* — George A. Herbster

(57) ABSTRACT

A charging handle for a firearm includes a T-handle with a receiving slot for a latch plate that pivots between latched and unlatched positions about a pivot pin. The latch plate includes a finger grip and a thumb pad that permit ambidextrous operation of the latch plate. A latch return assembly including a spring returns the latch plate to a latched position.

7 Claims, 5 Drawing Sheets

AMBIDEXTROUS CHARGING HANDLE FOR FIREARM

CROSS-REFERENCE TO RELATED APPLICATION

This application claims priority from U.S. Provisional Application Ser. No. 61/775,500 filed Mar. 9, 2013 for an Ambidextrous Charging Handle for Firearm which is hereby incorporated by reference.

BACKGROUND OF THE INVENTION

1. Field of the Invention

This invention is generally directed to firearms and more specifically to charging handles for use with firearms.

2. Description of Related Art

Charging handles for firearms enable shooters to retract and lock a bolt mechanism, or carrier block, in a firearm receiver to chamber a first round from a new magazine while in a firing position and without significantly moving the firearm from a sighted position. In addition, charging handles facilitate the clearing of a misfired round while the shooter remains in a shooting position. Newly developed sub-sonic ammunition generates gas pressures that are less than the pressures generated by other ammunition. Consequently, a bolt may not retract sufficiently to chamber a next round using such ammunition. Charging handles enable a shooter to manually chamber a round of such ammunition. In addition, the charging handle is designated to clear jammed ammunition and or bolt malfunctions.

A charging handle should have several characteristics or features. It should be easily accessible to a shooter while in a firing position, especially when the firearm includes optical sights. It should be lightweight and strong. A charging handle should be adapted for use in a wide variety of environments. It should be "ambidextrous" so it is easy to use by either a right-handed or left-handed shooter or while the firearm is at the shooter's left or right shoulder. Most importantly, a charging handle should be reliable and available at a reasonable cost.

International Patent Application WO2007/090611 discloses a hand-held firearm with a slide retraction lever, or charging handle, that can be operated ambidextrously. The lever comprises first and second handles arranged on opposite sides of the weapon. When one of the first and second handles is operated during a retraction process, an interlocking device assures that locks on both handles release from the weapon so that the lever can be retracted.

U.S. Pat. No. 7,240,600 (2007) to Bordson discloses a rifle charging handle for ambidextrous operation. The charging handle has a crossbar that supports first and second pivoted latch elements. The first latch element has a housing engaging element that engages the housing when the handle is in a forward, or latched, position. The first and second latch elements are engaged to each other such that pivoting the second latch element disengages the housing engaging element for the housing and releases the charging handle to be retracted.

U.S. Pat. No. 7,832,322 (2010) to Hoel discloses another embodiment of an ambidextrous charging handle in which an oblong T-handle contains a latch mechanism and a central shaft member that interacts with a locating flange on the handle. A pair of retaining and pivoting connectors secures the latch to the handle and the central shaft member. The latch mechanism includes cam activation by means of a retention relief acting against a fixed retention and pivot connector. A second retaining connector transmits the retraction force applied to the handle at one end of the latch and to the central shaft member through the interconnection of the second combination retention and pivot connector on the proximal end of the latch body.

U.S. Pat. No. 8,356,537 (2013) to Kincel discloses an ambidextrous charging handle in which a rod member engages the action for cocking the action mechanism. A handle at an open end of the rod member is secured to the edge of the action in a dormant state. A shooter can engage either of two finger members which swivel to become secured to each other to release the charging handle. Pulling on either of these finger members operates the other which moves the other finger member.

Each of the foregoing references discloses a charging handle with at least two independently pivoted structures that form a latching assembly. A first pivotally mounted element includes the latch and mounts to one side of the weapon. A second element mounts to the other side of the weapon. An interconnecting structure and spring assembly applies a force to return the latch elements to the latched position. Actuation of one of the elements causes an integral or separate linkage to reposition the other latch element. Each of these prior art charging handle arrangements requires multiple pivot positions and a linking structure that increases the overall cost of the charging handle, adds weight to the charging handle and increases the likelihood of a malfunction from a variety of causes, such as the migration of dirt and debris into the mechanism. What is needed is a charging handle that can be operated ambidextrously, that provides ready access, that is simple to operate from different shooting positions, that is reliable and that is cost effective.

SUMMARY

Therefore it is an object of this invention to provide a charging handle for a firearm that can be operated ambidextrously and that is reliable in operation.

Another object of this invention is to provide a charging handle that is adapted for ambidextrous use, provides reliable operation and is economical.

Still another object of this invention is to provide a charging handle that is readily adapted for use in firearms of different calibers.

In accordance with this invention a charging handle for a firearm includes a central shaft for supporting the charging handle for reciprocal motion in the firearm along a first axis and an integral handle forming a cavity therein and being located at one end of the central shaft and extending substantially perpendicularly to the first axis. A latch plate located in the cavity has a latch for engaging the firearm and enables an individual to apply a releasing force to the latch plate so it pivots from a latched position to an unlatched position that enables the withdrawal of the charging handle. A latch return subassembly located in the handle generates a force along an axis to urge the latch plate to its latched position. The second axis may extend obliquely to, or transversely to, the first axis.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
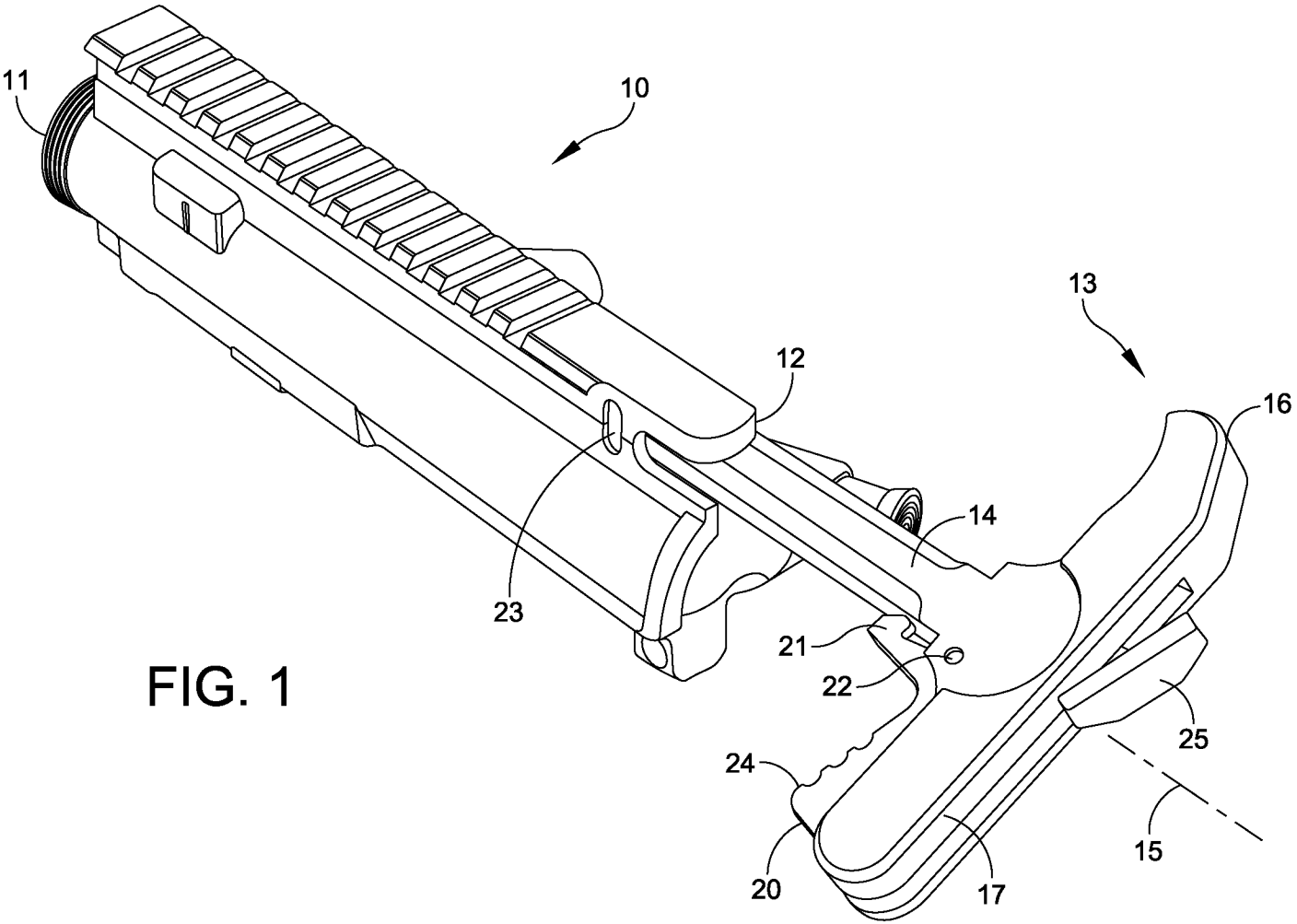
FIG. 1 is a perspective view of an upper receiver of a firearm with a charging handle extending therefrom.

FIG. 1 discloses an upper receiver 10 as a component of a firearm that terminates at a barrel end 11 and includes a charging handle receiving guide 12. In FIG. 1 a charging handle 13, constructed in accordance with this invention, extends from the other end from a handle receiving guide 12 opening at the end of the upper receiver 10 that is remote from the barrel end 11.

Figure 2:
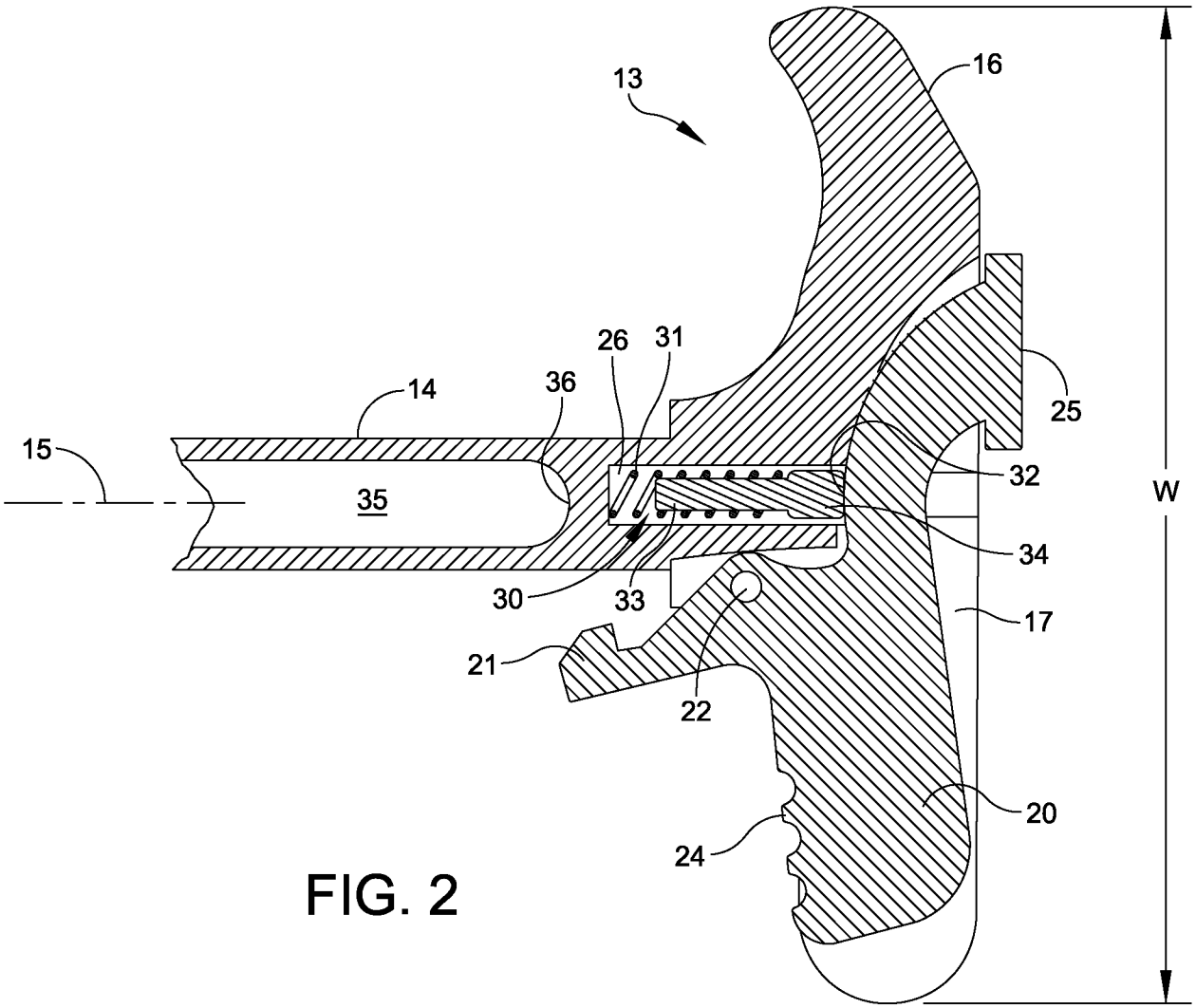
FIG. 2 is a cross-sectional view that depicts a version of a charging handle that incorporates one embodiment of this invention.

Referring to FIGS. 1 and 2, the charging handle 13 includes a central shaft 14 that fits within the handle receiving guide 12 to allow the charging handle 13 to reciprocate freely between the first and second axial positions along an axis 15. FIG. 2 depicts an arrangement in which a T-handle 16 that is integral to the central shaft 14 defines a cavity 17. The cavity 17 has an opening that extends transversely across the T-handle 15. A pivoted latch plate 20 includes a latch 21 and is mounted within the cavity 17 by a pivot pin 22 so that the latch 21 can engage a latch receiver 23 in FIG. 1 on the upper receiver 10 in a latched position. The latch plate 20 includes a left finger grip 24 and a thumb pad 25 to enable ambidextrous operation of the latch plate 20.

Still referring to FIG. 2 the charging handle 13 includes an axially extending spring channel 26 with a latch plate return means 30 for urging the pivoted latch plate 20 and latch 21 from an unlatched position shown in FIG. 2 into a latched position wherein the latch 21 engages the latch receiver 23 in FIG. 1. The latch plate return means 30 includes a spring 31 seated in the axial spring channel 26 and an insert 32 includes an insert shaft 33 that is coextensive with a portion of the spring 31 and terminates with an insert head 34. The insert head 34 engages an edge of the pivoted latch plate 20. As will be apparent from FIG. 2, the spring 33 and insert 32 urge the latch plate 20 clockwise around the pivot pin 23 to a normal latched position. The insert head 34 also closes the open end of the axial spring channel 26 to minimize or block any the transfer of debris into the axial spring channel 26. If a significant amount of debris enters the axial spring channel 26, it can block rotation of the pivoted latch plate 20 whereupon the charging handles 13 can malfunction.

The finger grip 24 enables a shooter to squeeze at that point to overcome the spring force and rotate the pivoted latch plate 20 counterclockwise to release the latch 21 from the latch receiver 23 in FIG. 1. Alternatively the shooter can produce the same releasing action by pressing on the thumb pad 25. The width, W, in one embodiment is about 3.0 inches (73 mm) which is greater than the width of commercially available competitive charging handles. The increased width provides a shooter ready access to the charging handle even if the charging handle lies between the firearm and any optics mounted on the firearm.

It has been found that a charging handle with an axial spring channel lying on the axis 15, such as the charging handle 13, can be limited as to the number of different firearm calibers that can be adapted for one design. For example, FIG. 2 depicts a central shaft 14 with an axially extending flute or opening 35 terminating at an end 36. Such an opening has accommodated firearms with different calibers. However, bolt displacement during firing in some platforms with newer calibers is greater than previously known so the bolt can strike the end 36 during use. This could be overcome by extending the length of the central shaft 14 between the opening 35 and the end of the axial spring channel 26. However, this requires a different model because prior models with a shorter distance of the opening have been accepted by customers.

Figure 3:
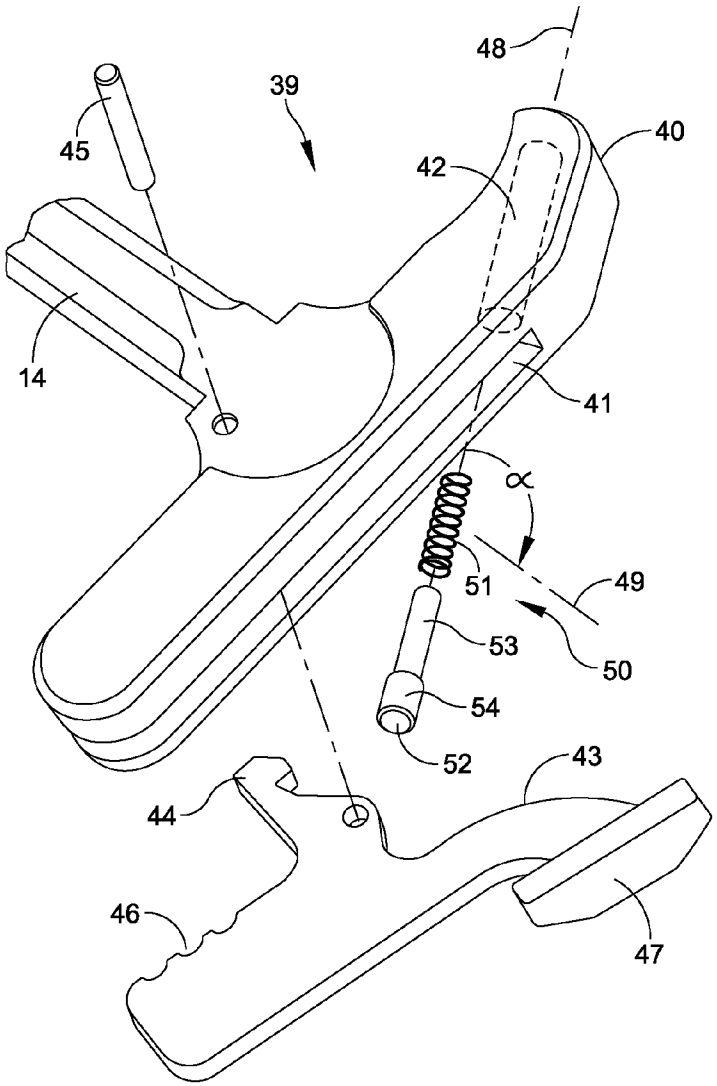
FIG. 3 is an exploded view to depict a portion of the charging handle of another embodiment of this invention.
Figure 4:
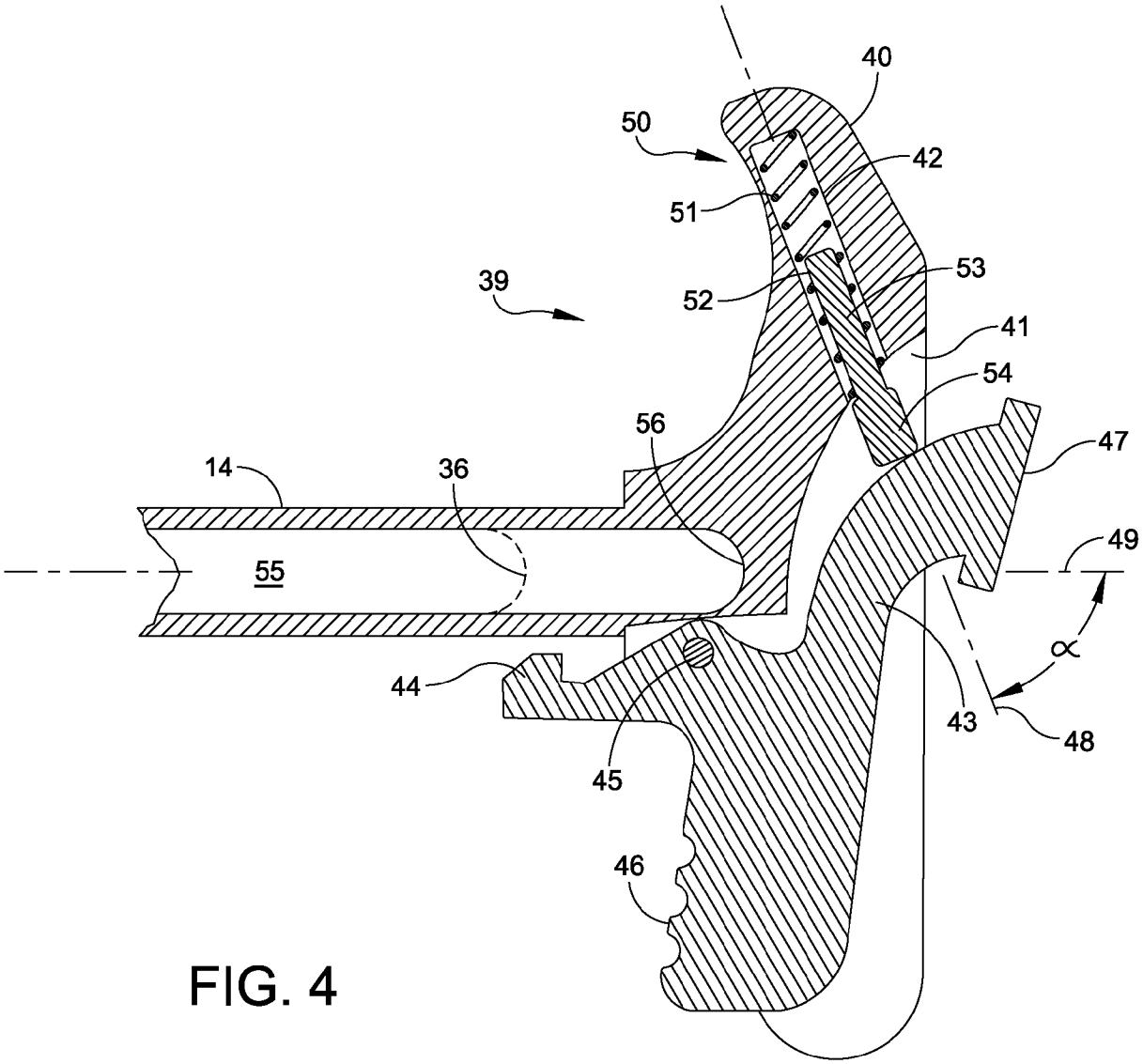
FIG. 4 is a cross-sectional view of the charging handle in FIG. 3 in a latched state.
Figure 5:
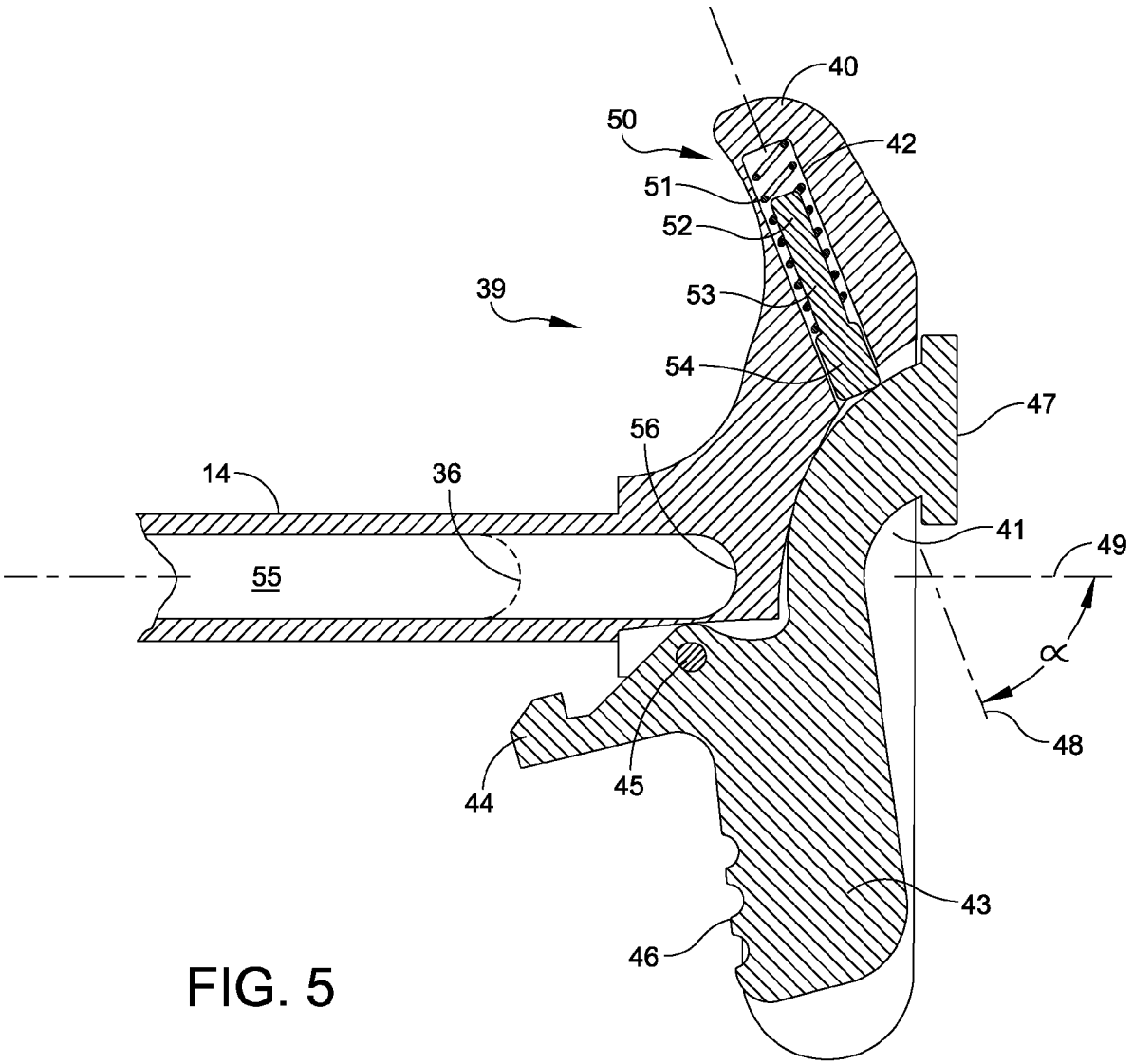
FIG. 5 is a cross-sectional view of the charging handle in FIG. 3 in an unlatched state.

FIGS. 3 through 5 depict a portion 39 of a charging handle with a T-handle 40 that overcomes the foregoing problems and enables a single model of a charging handle to be used in a number of different platform calibers. In this version, the axial spring channel 26 and the latch return means 30 of FIG. 2 are removed. A T-handle 40 includes a cavity 41 and a canted spring channel 42 and receives a modified latch plate 43 with a latch 44 and a pivot pin 45 that are positioned relative to the right end of the central shaft 14. The latch plate 43 additionally includes a left finger grip 46 and a thumb pad 47. In this embodiment the spring channel 42 lies along an axis 48 that is angularly displaced from an axis 49 of the central shaft 14 by an angle $\alpha$ (shown in FIG. 5) in the range of about 50° to about 70°. In this particular embodiment $\alpha \approx 66°$. The spring channel 42 receives a latch return means 50 comprising a compression spring 51 and an insert 52 with a shaft 53 and head 54. With this orientation, the force applied along the axis 48 is displaced to the right of the pivot pin 45 (i.e., on the opposite side of the pivot pin 45 from the latch 44. FIG. 4 depicts the pivoted latch plate 43 in a latched position that is a fully clockwise position maintained by the spring 51 and insert 52. When the shooter applies a force to the finger grip 46 or the thumb pad 47, the force overcomes the force applied by the spring 51 so the charging handle is released so the shooter can retract it. When the shooter releases the grip, the firearm bolt moves toward the barrel end of the firearm and the latch return means 50 will drive the latch 44 into a latch receiver, like the latch receiver 23 in FIG. 1.

This variation is shown with a flute or opening 55 in the central shaft 14 that is similar to the flute 35 in FIG. 2, and extends to an end 56 that is aligned to the right of the pivot pin. This occurs without weakening the structure of such a charging handle thereby providing a degree of standardization that can reduce manufacturing costs and improve reliability because this does not change the basic configuration of the charging handle.

In the embodiments described in FIGS. 2 through 5, the inserts 32 and 52 are formed of brass because they can be readily machined and they provide a lubricating function during use. Other materials, such as polytetrafluoroethylene, could be substituted to minimize any drag that may occur at the edge while also maintaining the feature of blocking the transfer of debris.

As will now be apparent, a charging handle constructed in accordance with this invention meets all of the objectives of this invention. Specifically a charging handle in accordance with this invention can be operated ambidextrously. It provides ready access and is simple to operate from different shooting positions. Moreover such a charging handle can be based on a generic design that is readily adapted for a range of firearm platforms of different calibers and that is reliable and cost effective.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A charging handle for a firearm comprising:

A) a central shaft for supporting said charging handle for reciprocal motion in the firearm along a first axis and including a latch receiver, B) an integral handle having a cavity therein, said integral handle being attached at one end of said central shaft and extending substantially perpendicularly to said first axis and carrying a single pivot extending along a pivot axis displaced from said first axis and transverse to said cavity, C) a one-piece latch plate having portions thereof located in said cavity on both sides of said first axis and being pivotally mounted in said cavity on said single pivot and including a latch that extends from one portion of said one-piece latch plate and exits said cavity to engage the latch receiver and first and second spaced unlocking means integral said one-piece latch plate and spaced from said latch, said first and second unlocking means extending from said cavity at first and second positions on opposite sides of said first axis for enabling ambidextrous operation of said charging handle when mounted to said firearm whereby application of a force to either of said first and second spaced unlocking means pivots said one-pieced latch plate thereby releasing said latch from the latch receiver, and D) latch return means located in said integral handle and engaging said one-piece latch plate to return the latch to the latched position upon termination of a force applied to said first and second unlocking means.

2. A charging handle as recited in claim 1 wherein the latch return means lies along a second axis that is canted to the first axis.

3. A charging handle as recited in claim 2 wherein said second axis is angularly offset from said first axis by an angle $\alpha$ wherein $\alpha$ is between about 50° and about 70°.

4. A charging handle as recited in claim 3 wherein $\alpha$ is approximately 66°.

5. A charging handle as recited in claim 1 wherein said latch return means includes a closed-end channel in said handle, a compression spring in said closed-end channel and an insert having a stem mounted concentrically with said spring and a head that closes the open end of said channel and engages said latch plate.

6. A charging handle as recited in claim 5 wherein said insert is formed of a material taken from the group consisting of brass and polytetrafluoroethylene.

7. A charging handle as recited in claim 1 wherein said latch return means lies along the first axis.

* * * * *